US006572100B1

(12) United States Patent
Tranquilla

(10) Patent No.: US 6,572,100 B1
(45) Date of Patent: Jun. 3, 2003

(54) PNEUMATIC PINCH FORCE GENERATOR FOR DOCUMENT TRANSPORT SYSTEM

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/929,231

(22) Filed: Aug. 13, 2001

(51) Int. Cl.[7] ..... B65H 5/06

(52) U.S. Cl. ..... 271/195; 271/272; 271/314; 399/167; 399/388

(58) Field of Search ..... 271/272, 314, 271/195, 276; 399/167, 388

(56) References Cited

U.S. PATENT DOCUMENTS 1,193,627 A * 8/1916 Staude ..... 271/195
3,684,363 A * 8/1972 Ito et al. ..... 271/900
3,770,266 A * 11/1973 Wehr et al. ..... 271/109
3,824,617 A * 7/1974 Kobayashi et al. ..... 360/16
3,867,026 A * 2/1975 Ogawa ..... 271/900
4,084,806 A * 4/1978 Wenthe et al. ..... 198/579
4,414,896 A * 11/1983 Fischer ..... 101/184
4,420,152 A * 12/1983 Miyashita ..... 271/309
4,441,806 A * 4/1984 Davis ..... 271/195
4,646,109 A * 2/1987 Toyama et al. ..... 226/95
5,031,002 A * 7/1991 Yaguchi ..... 271/196
5,459,562 A * 10/1995 Mitsuya et al. ..... 271/900
5,599,015 A * 2/1997 Shimizu et al. ..... 198/782
5,645,275 A * 7/1997 Tranquilla ..... 226/181
6,021,302 A * 2/2000 Janssens et al. ..... 399/315
6,097,006 A * 8/2000 Inukai ..... 219/497
6,270,075 B1 * 8/2001 Korhonen et al. ..... 271/194
6,338,480 B1 * 1/2002 Endo ..... 271/104
6,385,419 B1 * 5/2002 Genovese ..... 198/807

FOREIGN PATENT DOCUMENTS

JP 404101960 * 4/1992 ..... 271/195

* cited by examiner

*Primary Examiner*—Donald P. Walsh
*Assistant Examiner*—Daniel K Schlak
(74) *Attorney, Agent, or Firm*—Brooks & Kushman P.C.; Lise A. Rode; Mark T. Starr

(57) ABSTRACT

A document transport utilizes a pneumatic pinch force generator in lieu of a conventional spring-loaded pinch roller, thereby minimizing problems associated with pinch roller inertia and debris collection.

12 Claims, 3 Drawing Sheets

*Document in Entrance Transport*
*Prior Art*

*Document Motion Controlled by Capstan*
*Prior Art*

*Document in Exit Transport*
*Prior Art*

PNEUMATIC PINCH FORCE GENERATOR FOR DOCUMENT TRANSPORT SYSTEM

BACKGROUND OF THE INVENTION

The invention relates generally to apparatus to transporting documents past one or more document processing stations. More particularly, the invention relates to pinch force generation at various drive wheels or capstans of document transport apparatus.

FIGS. 1*a,* 1*b,* 1*c* illustrate the basic components of a conventional document transport system for stopping a document 102 after traveling at high speed in transport 100 so that information can be printed on document 102 with document processing apparatus, such as a printer 104. Printing magnetic ink character (MICR) amount fields on a check is a typical example of documents being processed. However, this invention applies to any other device that requires a document to be transported accurately in order to process it.

FIGS. 1*a, b, c* illustrate the case of a relatively short document 102. In the document's stopped position at printer 104, only one drive roller, in this case capstan 112, is in contact with the document 102. Typically, document 102 is moved at high speed up to a print station 104 with an entrance transport 106, usually running at a high, constant speed. A typical entrance transport includes an input drive roller 108 and a companion pinch roller 110, between which document 102 travels. When document 102 is in the grip of the capstan 112 and its associated pinch roller 114 only, capstan 112 and hence document 102 is decelerated to the desired stop position relative to the document processing station, in this example, print station 104.

Edge sensor 116 is positioned a known distance from the desired stop position. Motion of the capstan 112 is controlled by a single motor (not shown) which is a part of a servo feedback control loop. Such methods of positioning documents are well known to those practiced in the art of document processing.

After printing on document 102 using hammer bank 118, print drum 120 and ribbon 121 of print station 104, document 102 is accelerated up to the speed of the exit transport 122 by the capstan 112. The exit transport 122, usually running at high, constant speed, moves document 102 to other devices for further processing or to a document transport exit via drive roller 124 and its associated pinch roller 126.

Pinch rollers 110 and 126 are normally spring loaded against the entrance and exit drive rollers 108 and 124, respectively, and pinch roller 114 against the capstan 112 to provide drive force for the document 102. This is likewise common practice in the art.

During deceleration of document 102 by capstan 112, pinch roller 114 must also undergo this same deceleration. However, as a practical matter, pinch rollers, such as 114, have considerably more inertia than a document, such as a check. Therefore, the inertia of pinch roller 114 can carry document 102 with it and cause the document 102 to go past its intended stop position, if document 102 slips on capstan 112.

Previous practice increased the force on pinch roller 114 to help prevent document slippage or sliding with respect to capstan 112. However, large pinch forces can result in excessive loads on capstan 112, pinch rollers 110, 114 and 126 and their support systems and bearings, causing premature failure of these components. Large pinch forces also require capstan drive motors to provide large amounts of power thereby wasting energy.

The above problems with pinch rollers also apply during the document's acceleration. In this case, document 102 won't accelerate as fast as capstan 112. This, in turn, leads to two negative effects. First, documents behind document 102 being processed may crash into it. Second, document 102 may not get up to the exit transport speed before it enters the nip of the exit transport, thereby causing poor document control.

SUMMARY OF THE INVENTION

Accordingly, in one aspect of this invention, a document transport including at least one drive roller includes apparatus for providing pinch force to a document abutting the drive roller. A nozzle has an inlet and an outlet, the outlet facing the drive roller and spaced therefrom for permitting documents to pass therebetween. A source of compressed fluid, such as air, is coupled to the inlet of the nozzle thereby enabling it to provide pinch force pneumatically by a compressed fluid flow towards the drive roller.

In another aspect of the invention, a document transport system for carrying documents past a document processing station includes an entrance transport including at least one entrance drive roller adapted to propel documents into the transport system, a capstan positioned downstream of the at least one entrance drive roller, the capstan positioned upstream of the document processing station and adapted to propel documents into the document processing station, an exit transport including at least one exit drive roller adapted to propel documents away from the processing station, and a pneumatic pinch force generator positioned opposite at least one of the at least one entrance drive roller, the capstan and the at least one exit drive roller for applying pinch force to a document passing between the pneumatic pinch force generator and at least one of the at least one entrance drive roller, the capstan and the at least one exit drive roller.

BRIEF DESCRIPTION OF THE DRAWINGS

The objects and features of the invention will become apparent from a detailed description, taken in conjunction with the drawing, in which.

DETAILED DESCRIPTION OF THE PREFERRED EMBODIMENTS

Figure 1A:
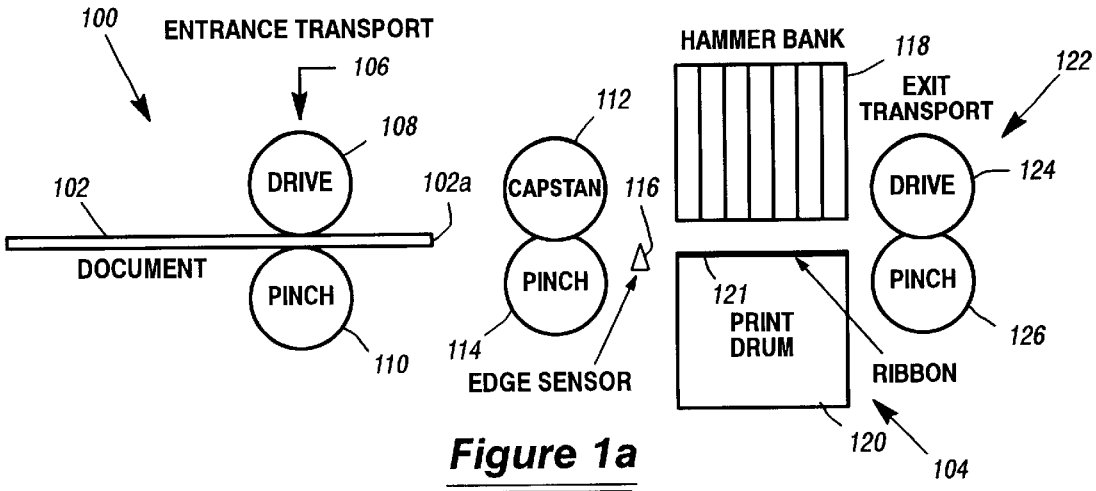
FIGS. 1*a,* 1*b,* and 1*c* depict a prior art document transport arrangement for passing documents by a document processing station.
Figure 1B:
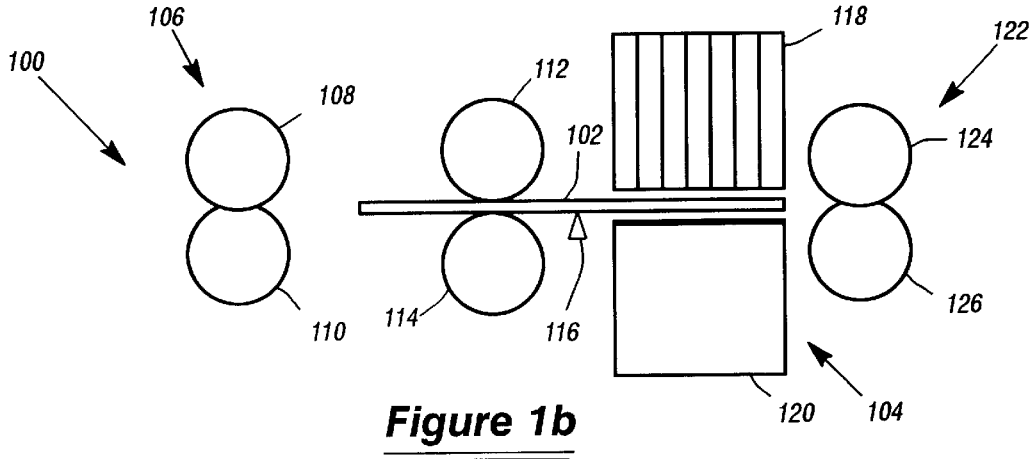
Figure 1C:
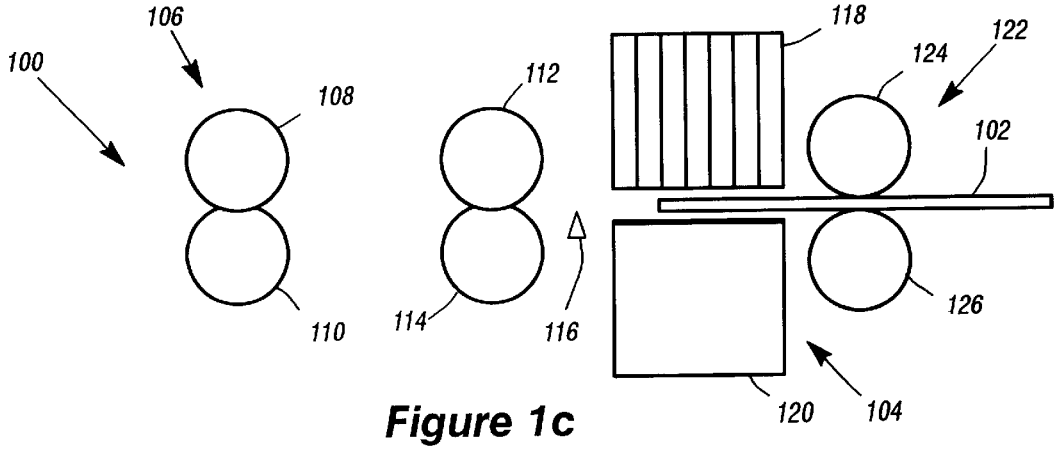
Figure 2:
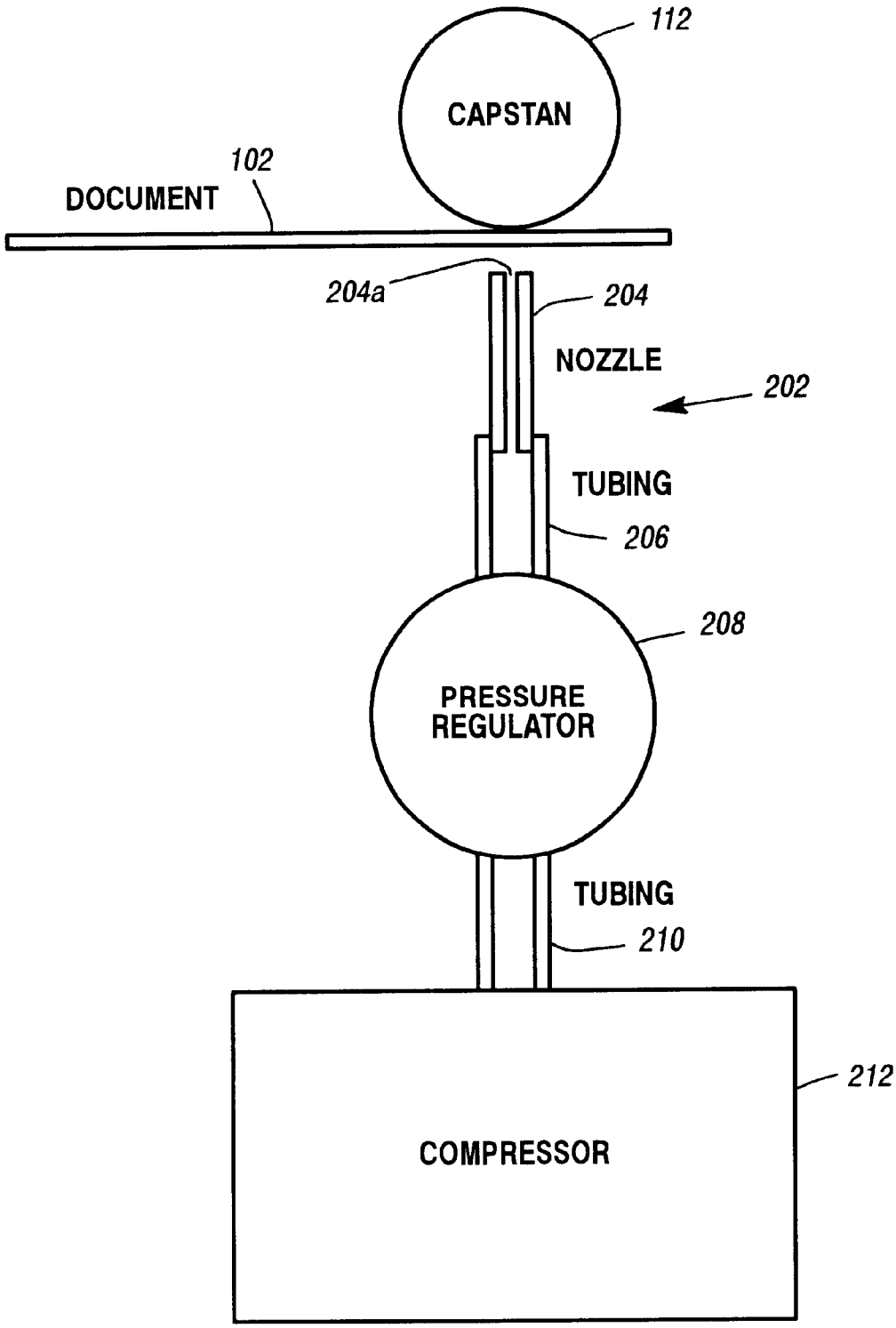
FIG. 2 sets forth a first embodiment of a pinch force generating arrangement for a document transport arranged in accordance with the principles of the invention.

In essence, the invention eliminates the inertia of a conventional pinch roller by eliminating the pinch roller itself. The pinch roller's primary function is to provide pinch force between document 102 and a drive element, such as capstan 112. This pinch force can be provided in accordance with the invention by a high velocity fluid jet as shown in FIG. 2.

A nozzle 204 is positioned so that it points towards the location on capstan 112 where it is desired to produce a pinch force. Nozzle 204 is connected to a pressure regulator 208 via appropriate tubing 206.

Pressure regulator 208 is connected to a source of compressed fluid, such as air, at compressor 212 via tubing 210. Compressor 212 provides a high pressure supply of fluid, preferably air. Regulator 208 provides a means of adjusting for, or maintaining a desired pressure at, the outlet 204*a* of nozzle 204.

The resultant air jet at outlet 204*a* impinges on document 102, thereby forcing document 102 against capstan 112. This provides the requisite pinch force between document 102 and capstan 112, thereby preventing documents from slipping on capstan 112 during acceleration and deceleration of document 102. Lower pinch forces are usable with the invention, since the invention eliminates the need to deal with pinch roller inertia.

It will be apparent to those skilled in the art that the pneumatic pinch force generator shown in FIG. 2 could be used with other elements in the document transport system apart from capstan 112. Indeed, such pinch force generators could be placed anywhere in a conventional system which in the past would have used conventional spring-loaded pinch rollers.

In most document processors, there is space between documents flowing in the transport. An air jet from nozzle 204 impinges on capstan 112 during this time. An additional advantage of the pneumatic pinch force generator is that the air jet helps keep capstan 112 free of debris and paper dust. This cleansing action, in turn, helps maintain a high coefficient of friction between capstan 112 and document 102, permitting high values of acceleration and deceleration without document slippage.

In some document processors, printing occurs on the back of the documents prior to the document being engaged by the capstan. Endorsing of checks is one example. Because document speeds may be very high, as much as 300 inches per second or higher, ink applied to the document at a preceding station may not be dry before the document reaches the capstan. As a result, some ink may get transferred from the document to the capstan. An additional advantage of the pneumatic pinch force generator as shown in FIG. 2 is that it helps keep the capstan 112 dry. This also helps maintain high coefficient of friction between capstan 112 and document 102, again permitting high values of document acceleration or deceleration along the transport path.

Figure 3:
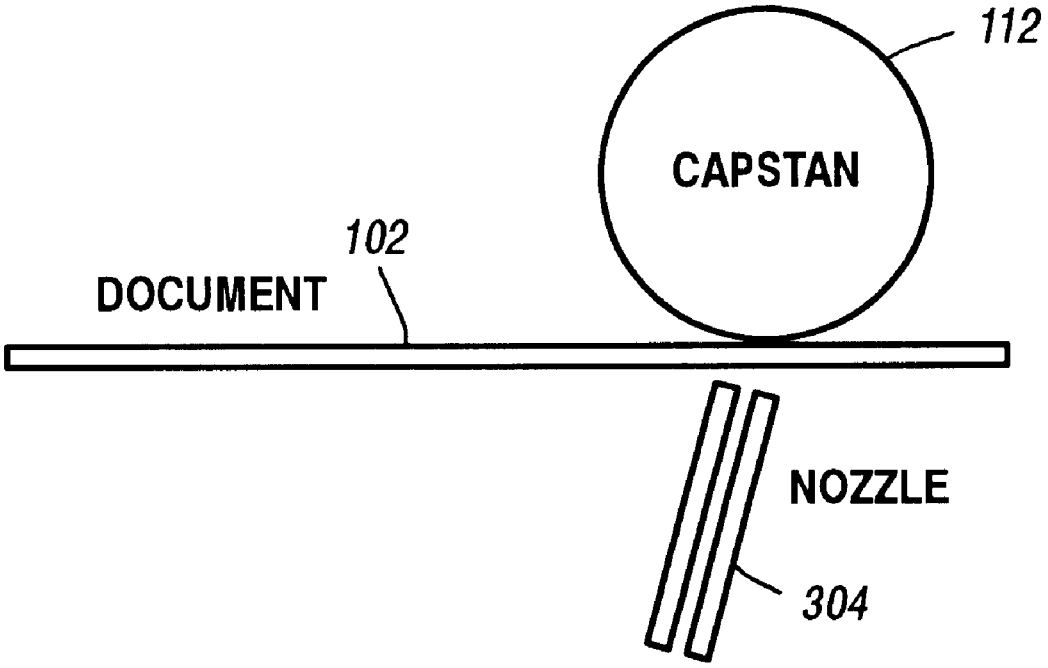
FIG. 3 sets forth an alternative embodiment of a pinch force generating arrangement of the invention.

FIG. 3 sets forth an alternative embodiment of the pneumatic pinch force generator of the invention wherein nozzle 304 directs a compressed fluid stream at the documents in a direction downstream of document travel. This embodiment is useful in the case of processing a set of documents having a large percentage of damaged leading edges or where there are documents made of very thin material. Air may spill out in a direction against the document flow when the air jet is impinging on capstan 112 perpendicularly to the path of document travel. A document approaching the capstan may have its leading edge turned back by this spillage. Hence, directing nozzle 304 slightly downstream in the direction of document flow prevents this problem.

The invention has been described with reference to exemplary embodiments. The scope and spirit of the invention are to be determined from appropriately interpreted claims herein.

What is claimed is:

1. In a document transport of the type in which individual documents are moved with an entrance transport up to a processing station, the entrance transport including a drive roller and an edge sensor for detecting document edges wherein the drive roller is controlled to rapidly decelerate a document to stop the document at a desired stop position in response to detection of a document edge by the edge sensor, the drive roller thereby providing the rapid deceleration of the document to a stop at the processing station and subsequent rapid acceleration of the document after processing, an apparatus for providing pinch force to a document abutting the drive roller comprising:

a nozzle having an inlet and an outlet, the outlet facing the drive roller and spaced therefrom for permitting a document to pass therebetween to cause the document to be pinched between the drive roller and a fluid flow from the nozzle, the nozzle being directed such that fluid flow therefrom has a component normal to the drive roller to pinch the document, wherein the drive roller is controlled in a manner to rapidly decelerate the document to a stop and subsequently accelerate the document after processing at the processing station; and a source of compressed fluid coupled to the inlet of the nozzle.

2. The apparatus of claim 1 further comprising a pressure regulator coupled between the source of compressed fluid and the inlet of the nozzle.

3. The apparatus of claim 1 wherein the drive roller comprises a capstan of the document transport.

4. The apparatus of claim 1 wherein the nozzle outlet is positioned to direct fluid substantially perpendicularly to a path of travel of the document abutting the drive roller.

5. The apparatus of claim 1 wherein the nozzle outlet is positioned to direct fluid downstream of a path of travel of the document abutting the drive roller.

6. The apparatus of claim 1 wherein the fluid comprises air.

7. A document transport system for carrying documents past a document processing station comprising:

an entrance transport including at least one entrance drive roller adapted to propel documents into the transport system;

a capstan positioned downstream of the at least one entrance drive roller and positioned upstream of the document processing station and adapted to propel documents into the document processing station;

an exit transport including at least one exit drive roller adapted to propel documents away from the processing station; and a pneumatic pinch force generator positioned opposite at least one of the at least one entrance drive roller, the capstan and the at least one exit drive roller for applying pinch force to a document passing between the pneumatic pinch force generator and at least one of the at least one entrance drive roller, the capstan and the at least one exit drive roller to cause the document to be pinched by a fluid flow from the pneumatic pinch force generator wherein the document transport system is controlled in a manner to rapidly decelerate the document to a stop and subsequently accelerate the document after processing at the processing station.

8. The document transport system of claim 7 wherein the pneumatic pinch force generator further comprises:

a nozzle having an inlet and an outlet, the outlet facing at least one of the at least one entrance drive roller, the capstan and the at least one exit drive roller; and a source of compressed fluid coupled to the inlet of the nozzle.

9. The document transport of claim 8 wherein the pneumatic pinch force generator further comprises:

a pressure regulator coupled between the source of compressed fluid and the inlet of the nozzle.

10. The document transport system of claim 9 wherein the compressed fluid comprises air.

11. The document transport system of claim 8 wherein the nozzle outlet faces at least one of the at least one entrance drive roller, the capstan and the at least one exit drive roller in a direction perpendicular to the path of document travel.

12. The document transport system of claim 8 wherein the nozzle outlet faces at least one of the at least one entrance drive roller, the capstan and the at least one exit roller in a direction to direct fluid flow downstream of a path of travel of the document.

* * * * *